US008162144B2

(12) United States Patent
Intini

(10) Patent No.: US 8,162,144 B2
(45) Date of Patent: Apr. 24, 2012

(54) CHILD RESISTANT AND SENIOR FRIENDLY CONTAINER

(76) Inventor: Thomas D. Intini, Brossard (CA)

( * ) Notice: Subject to any disclaimer, the term of this patent is extended or adjusted under 35 U.S.C. 154(b) by 2379 days.

(21) Appl. No.: 10/439,948

(22) Filed: May 16, 2003

(65) Prior Publication Data

US 2004/0226853 A1 Nov. 18, 2004

(51) Int. Cl.
*B65D 83/04* (2006.01)

(52) U.S. Cl. ..... 206/532; 206/1.5; 220/324

(58) Field of Classification Search ..... 206/531, 206/1.5, 532, 538, 539; 220/281, 253, 324; 215/209

See application file for complete search history.

(56) References Cited

U.S. PATENT DOCUMENTS

| | | | | |
|---|---|---|---|---|
| 5,019,125 | A * | 5/1991 | Rebne et al. | 206/532 |
| 5,346,069 | A * | 9/1994 | Intini | 206/531 |
| 5,740,938 | A * | 4/1998 | Hofmann et al. | 220/324 |
| 5,988,429 | A * | 11/1999 | Coe | 221/25 |
| 6,021,901 | A * | 2/2000 | Wolfe | 206/531 |
| 6,832,686 | B2 * | 12/2004 | Donegan | 206/531 |

* cited by examiner

*Primary Examiner* — Mickey Yu
*Assistant Examiner* — Chun Cheung
(74) *Attorney, Agent, or Firm* — Eric Fincham

(57) ABSTRACT

There is provided a child-resistant container having a top and bottom hingedly connected together, first, second and third cooperative locking devices on both the upper and lower members, the locking devices being operative such that a first locking device can be operated to permit a limited unlocking between the two members at which time the second and third locking devices must be operated to fully open the container. A double locking action on two of the locking devices is illustrated as well as an arrangement for dispensing a product from a blister pack within the container.

7 Claims, 5 Drawing Sheets

CHILD RESISTANT AND SENIOR FRIENDLY CONTAINER

FIELD OF THE INVENTION

The present invention relates to containers and more particularly, relates to a child-resistant/senior friendly package suitable for containing medicants.

BACKGROUND OF THE INVENTION

The use of child-resistant packaging is well known in the art and is utilized for many different types of goods. The present invention is primarily directed to packaging for those products which represent a potential hazard in the hands of children—i.e. medicaments and the like.

Packaging and design to be child-resistant while still being senior-friendly will depend upon the product being utilized—i.e. size, format, etc. For example, in the field of pharmaceuticals, many different types of pill containers are used commercially. They generally have locking tops which require either a certain alignment between the top and container or a specific force exerted on the top. Also known are individually packaged medicaments which are often sealed in different types of blister packages which are designed to prevent easy access by children.

In designing child-resistant packaging, it is important that the package can be opened without undue difficulty by the average consumer for whom the product is intended. This is frequently a problem and one of the primary users of medication are the elderly, and packaging which relies on a certain amount of strength to open is often self-defeating and at the end users find it difficult or impossible to open such packaging. As a result, compliance with taking the medication may be low.

Some pharmaceutical products are packaged in the form of pills or tablets and are sealed in child-resistant blister packages. Frequently, these packages are difficult for the elderly to open.

SUMMARY OF THE INVENTION

It is an object of the present invention to provide a child-resistant package which is senior friendly.

It is a further object of the present invention to provide packaging suitable for a number of different items and wherein a substantial amount of strength is not required while still incorporating child-resistant features.

It is a further object of the present invention to provide packaging wherein medicaments in blister packages may easily be removed therefrom.

It is a further object of the present invention to provide packaging providing feel safe features should a portion of the package be accidentally opened.

According to one aspect of the present invention, a child-resistant container comprising a bottom member adapted to receive and contain at least one item to be packaged, the bottom member having a base and at least one wall extending upwardly therefrom, a cover member, first, second and third cooperative locking devices on both the cover member and the bottom member, the first, second and third locking devices being operative such that when the cover member is in a closed position with respect to the bottom member, the locking devices function to maintain the cover member and bottom member in a locked relationship, the first locking device permitting limited movement between the cover member and bottom member while maintaining a locking relationship such that the second and third locking devices may be moved to an unlocked position while the first locking device is locked, and the second and third locking devices include means to prevent opening of the container when only one of the second and third locking devices is opened.

According to a further object of the present invention, there is provided a child-resistant container comprising a bottom member adapted to receive and contain at least one item to be packaged, the bottom member having a base and at least one wall extending upwardly therefrom, a cover member, first, second and third cooperative locking devices on both the cover member and the bottom member, the first, second and third locking devices being operative such that when the cover member is in a closed position with respect to the bottom member, the locking devices function to maintain the cover member and bottom member in a locked relationship, the first locking device permitting limited movement between the cover member and bottom member while maintaining a locking relationship such that the second and third locking devices may be moved to an unlocked position while the first locking device is locked, the second and third locking devices include means to prevent opening of the container when only one of the second and third locking devices is opened, a plurality of projections extending outwardly from an inner surface of the bottom member, a blister package having a plurality of blister pockets covered by a rupturable foil, the blister package being placed such that at least one of the blister pockets rests on at least one of the projections such that when pressure is applied, a product in the blister pocket will be forced through the rupturable foil.

The present invention provides a child-resistant container which is improvement over the prior art such as shown in U.S. Pat. No. 5,346,069 in that there is provided a double locking feature on the side wall locks. This prevents only one of the locks being opened by a child and sufficient force being exerted to cause the other side lock to likewise open.

Also, in a preferred embodiment of the present invention, there are provided means within the container to store blister packs and aids to assist in the dispensing of a product from the blister pack.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
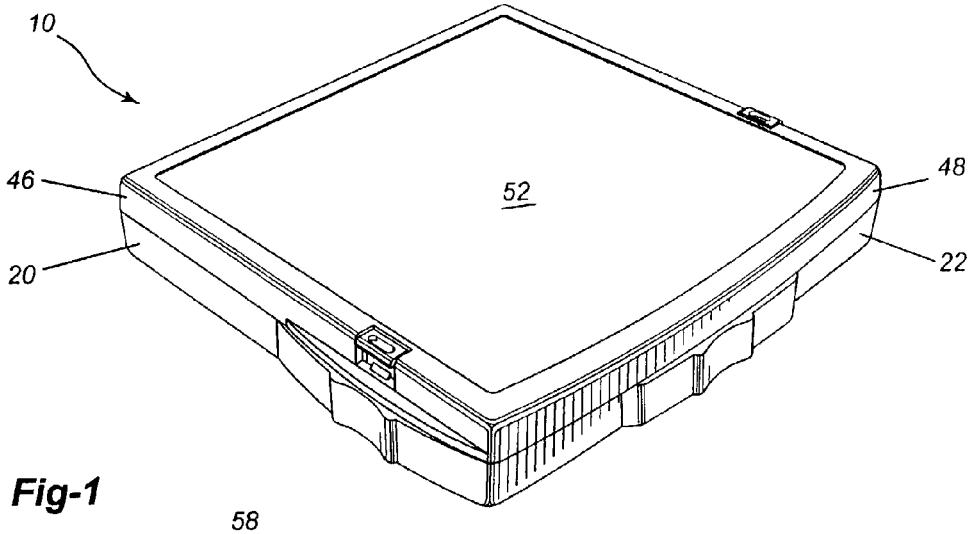
FIG. 1 is a perspective view of a container according to the present invention in a closed position.

Referring to the drawings in greater detail and by reference characters thereto, there is illustrated a container generally designated by reference numeral 10.

Figure 2:
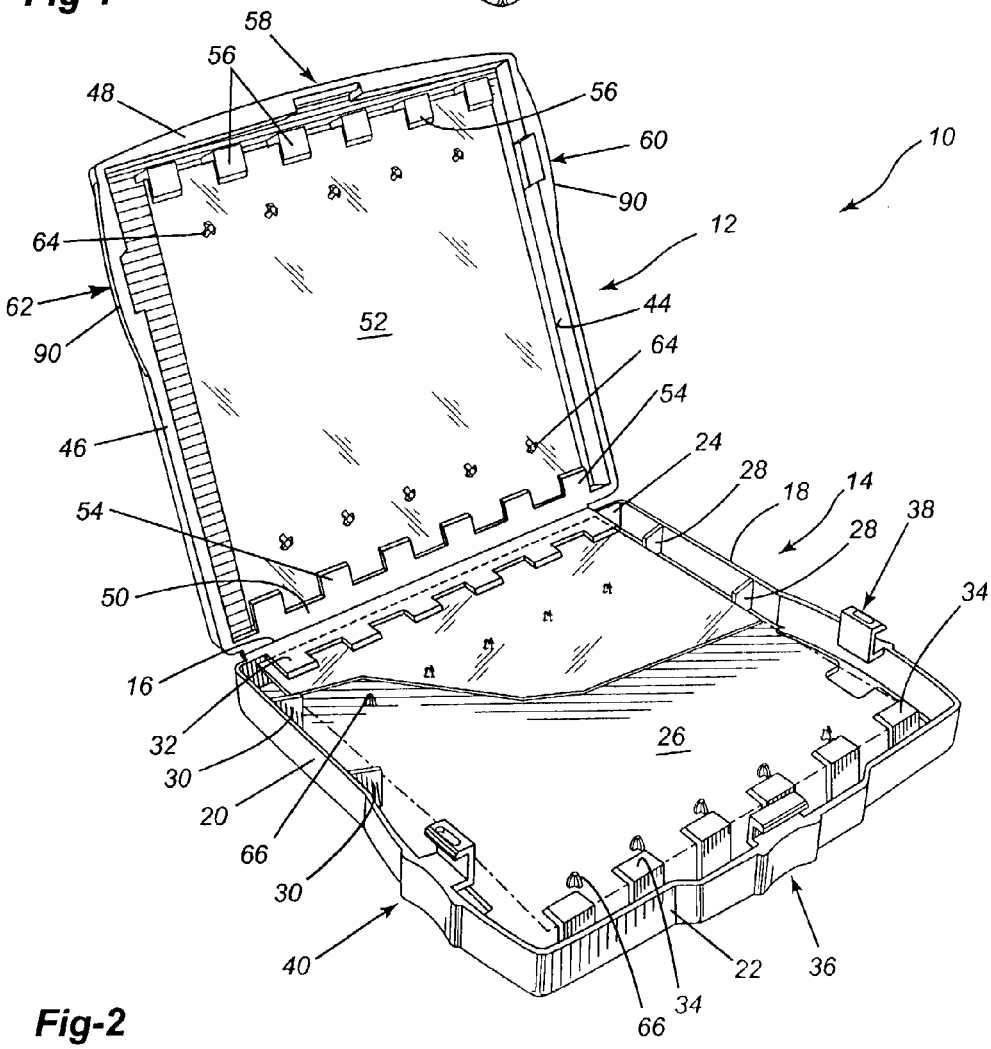
FIG. 2 is a perspective view of the container of FIG. 1 in an open position.

Container 10, as may be seen in FIG. 2, has a bottom member generally designated by reference numeral 14 and a cover member generally designated by reference numeral 12. Cover 12 and bottom member 14 are connected by means of a living hinge 16.

Bottom member 14 includes a first lower side wall 18 and an opposed lower side wall 20. Extending between side walls 18 and 20 is a lower front wall 22 and a lower rear wall 24. Forming the base of bottom member 14 is a bottom wall 26.

Extending outwardly from lower side wall 18 are positioning ribs 28 for reasons which will become apparent hereinbelow. Similarly, positioning ribs 30 extend outwardly from lower side wall 20.

As also being seen, extending from lower rear wall 24 are a plurality of retaining tabs 32 while a plurality of retaining tabs 34 extend upwardly and inwardly from bottom wall 26 proximate lower front wall 22.

Formed in lower front wall 22 is a lower front locking element generally designated by reference numeral 36 and which will be described in greater detail hereinbelow. Similarly, formed in side walls 18 and 20 are lower side locking elements 38 and 40 respectively.

Cover 12 includes a first cover side wall 44 and a second cover side wall 46. A cover front wall 48 extends between cover side walls 44 and 46 as does cover rear wall 50. There is also provided a cover top wall 52.

Extending inwardly from cover rear wall 50 are a plurality of retaining tabs 54 similar to bottom retaining tabs 32. Extending outwardly from cover top wall 52 adjacent cover front wall 48 are retaining tabs 56.

Cover 12 is also provided with locking elements designed to cooperate with locking elements on the bottom member 14 and to this end, there is provided a top front wall locking element 58, and top side wall locking elements 60 and 62 associated with side walls 44 and 46 respectively.

For reasons which will be discussed hereinbelow, extending inwardly from cover top wall 52 are a plurality of projections 64; similarly, there are provided bottom wall projections 66 which extend outwardly from bottom wall 26.

Figure 8A:
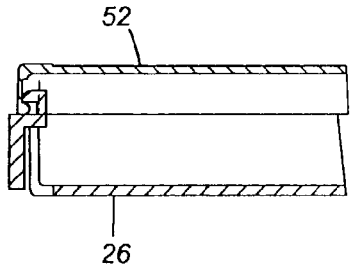
FIGS. 8*a*, 8*b* and 8*c* are sectional views taken along the lines 8-8 of FIG. 5 showing the opening of the container.

The lock arrangement of top front wall locking element 58 and lower front wall locking element 36 will now be described. In this respect, and as may be seen in FIGS. 8*a* to 8*c*, lower front wall locking element 36 includes a first inwardly extending portion 70 from which extends a vertical portion 72. A second horizontal portion 74 parallel to inwardly extending portion 70 thereby defines a hook type member. Provided in cover top wall 52 is a recess 76 into which horizontal portion 74 will fit and thereby retain the cover 12 and bottom member 14 in a locked position.

Each of the side locking members is identical and thus, only one will be described in detail herein. Thus, each of the lower side wall locking elements 38 and 40 comprise a first inwardly extending section 80, a vertical section 82 extending upwardly therefrom, and a horizontal section 84. Horizontal section 84 has a slot 86 formed therein.

Figure 4:
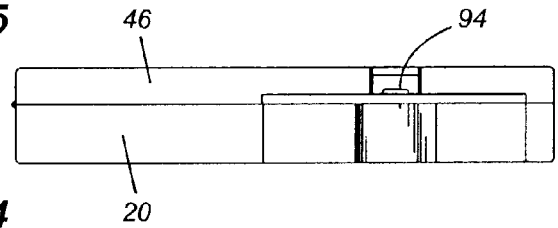
FIG. 4 is a side elevational view thereof.
Figure 6:
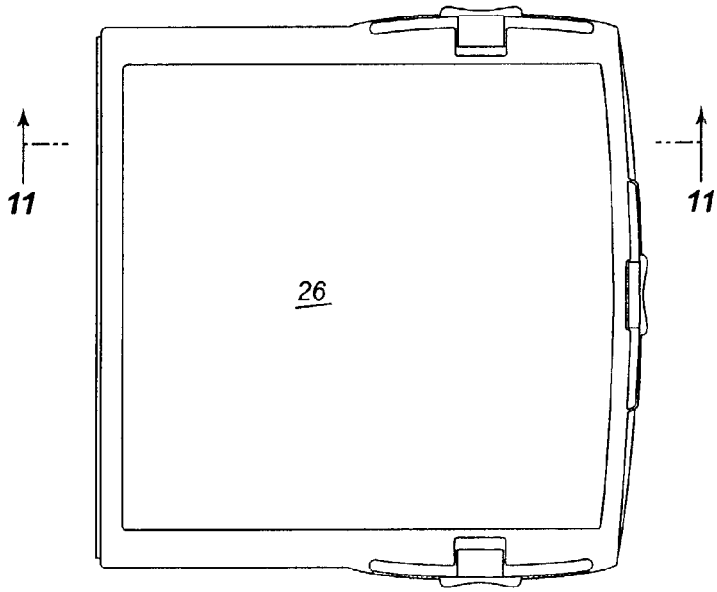
FIG. 6 is a bottom plan view thereof.
Figure 7:
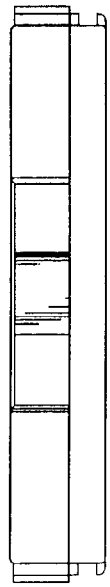
FIG. 7 is a front elevational view thereof.

Each of top side wall locking elements 60 and 62 include a flange 90 extending along side walls 44,46. An aperture generally designated by reference numeral 92 is formed in side walls 44, 46 and is designed to receive horizontal portion 84 to enter into a locking relationship. It will be noticed that there is a second locking projection 94 (FIG. 4) provided on flange 90 and which is designed to seat within slot 86.

Figure 8B:
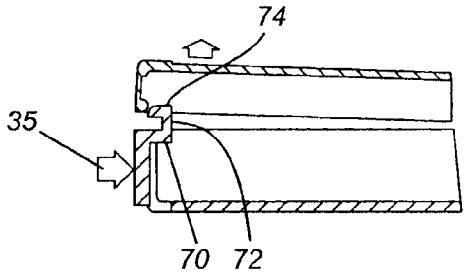
Figure 8C:
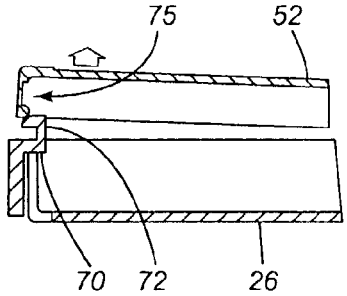
Figure 9A:
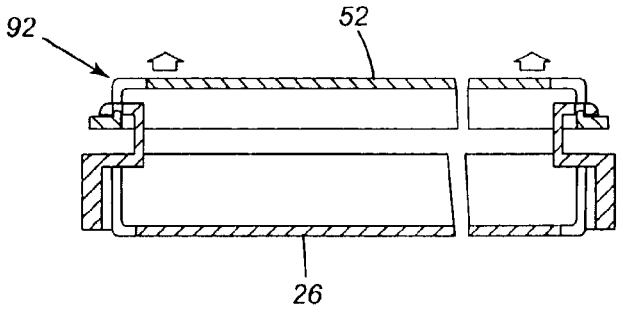
FIGS. 9*a* and 9*b* are sectional views taken along the lines 9-9 of FIG. 5 showing the locked and open positions.
Figure 9B:
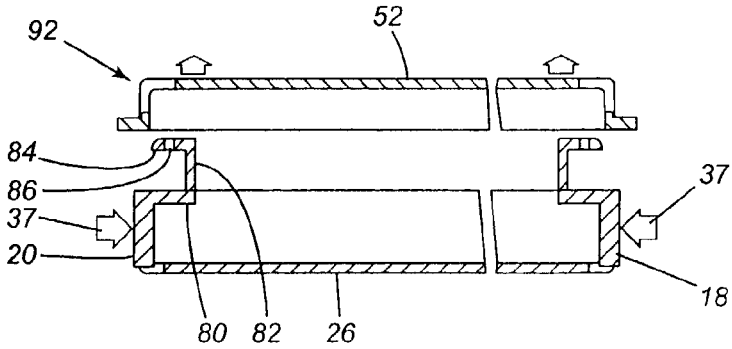
Figure 10:
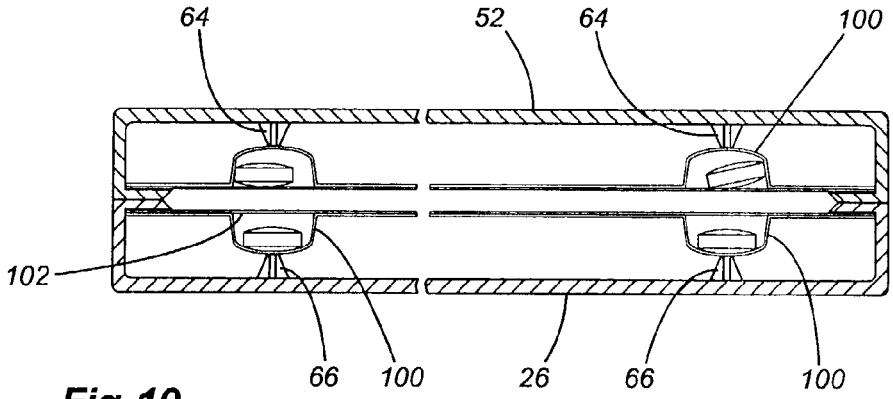
FIG. 10 is a sectional view taken along the lines 11-11 of FIG. 6.
Figure 11:
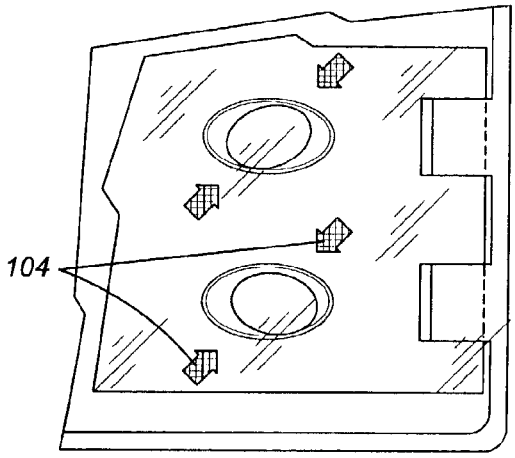
FIG. 11 is a partial view illustrating the placement of a blister package within the container.

In operation, for the opening of the container, pressure is initially exerted on lower front wall 22 to disengage lower front wall locking element 36 from top front wall locking element 58 as designated by arrow 35 may be seen in FIG. 8*b*.

Subsequently, pressure is exerted (as shown by arrow 37) on lower side wall locking elements 38 and 40 to disengage the same from top side wall locking elements 60 and 62 respectively.

In respect to the above, the unlocking of the container is a sequential event. Thus, one can operate the unlocking of front wall locking elements 36 and 58 which will permit a limited movement of the cover 12 with respect to bottom member 14. In other words, at this point in time, side wall locking elements 38, 40, 60 and 62 are designed to permit limited movement. Subsequently, pressure must be placed on the lower side wall locking elements 38 and 40 to disengage the same.

The engagement of locking projection 94 with slot 86 provides a substantial safety feature with respect to the child-resistant nature of the pack. Due to these locking projections, it becomes extremely difficult to open only one side and have the other side disengaged. Rather, the secondary locking effect makes the same very difficult to achieve.

Figure 12A:
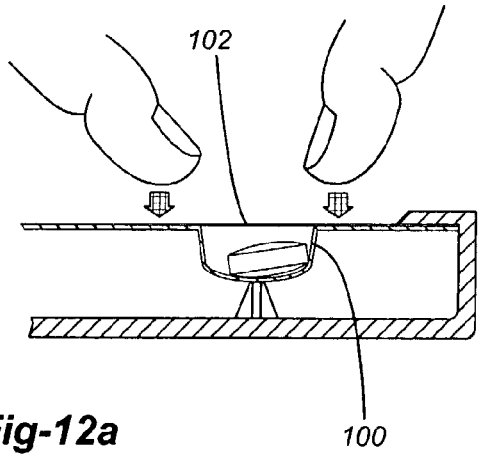
FIGS. 12*a* and 12*b* are sectional views illustrating the removal of an object from a blister pocket.
Figure 12B:
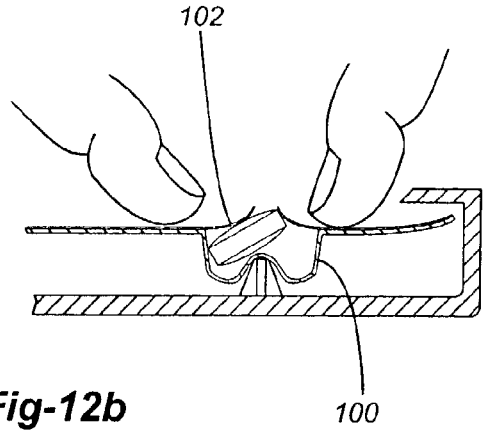

As previously mentioned, the present invention may be utilized with blister packs which typically have a first blister layer with blister pockets 100 sealed with a foil layer 102 as shown in FIGS. 10 to 12*b*. In this respect, the arrangement is such that projections 64 and 66 are each associated with a blister pocket 100 such that when pressure is placed on the blister package as shown in FIGS. 12*a* and 12*b*, the contents will rupture through the foil 102 and access may be had thereto.

In order to assist in the opening of the package, indicator arrows 104 may be provided on the foil layer 102. Thus, as shown in FIGS. 12*a* and 12*b*, pressure would be exerted on the arrows 104 to thereby rupture the foil 102 to permit access to the contents of the blister pocket 100.

Figure 3:
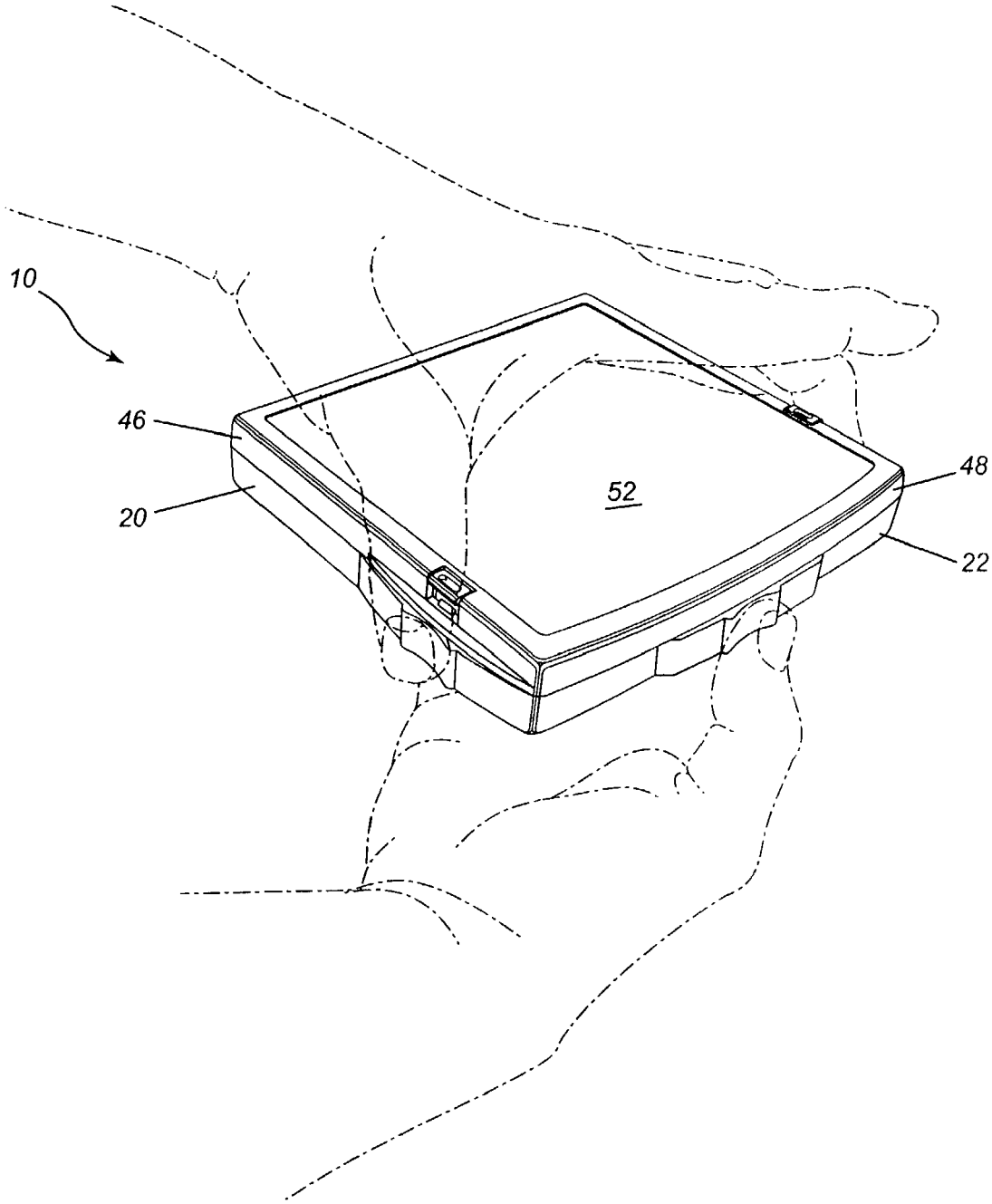
FIG. 3 is a perspective view of the container in a closed position showing operation of the opening of the container.
Figure 5:
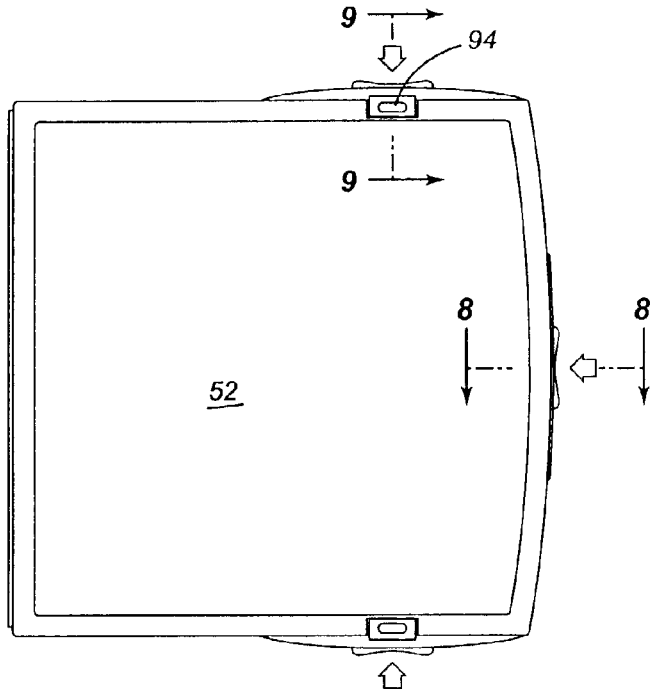
FIG. 5 is a top plan view thereof.

Also, as may be seen in FIG. 3, the opening of the package may conveniently be accomplished by using a thumb to open the front locking members and using a thumb and finger to open the side locking members.

It will be understood that the above described embodiments are for purposes of illustration only and that changes or modifications may be made thereto without departing from the spirit and scope of the invention.

I claim:

1. A child-resistant container comprising:

a bottom member adapted to receive and contain at least one item to be packaged, said bottom member having a base and at least one wall extending upwardly therefrom;

a cover member;

first, second and third cooperative locking devices on both said cover member and said bottom member;

said first, second and third locking devices being operative such that when said cover member is in a closed position with respect to the bottom member, said locking devices function to maintain the cover member and bottom member in a locked relationship;

said first locking device permitting limited movement between the cover member and bottom member while maintaining a locking relationship such that the second and third locking devices may be moved to an unlocked position while said first locking device is locked; and said second and third locking devices each further including secondary locking means to prevent opening of the container when only one of said second and third locking devices is opened.

2. The container of claim 1 wherein said container is an overall rectangular configuration with a front wall, a back wall and a pair of side walls extending upwardly from said base, said second and third locking devices being located on opposite side walls of the container.

3. The container of claim 2 wherein each of said second and third locking devices comprises a tab extending from one of said members, an aperture formed in the other said members, said tab member being adapted to engage the aperture to thereby lock the members together.

4. The container of claim 3 wherein said secondary locking means associated with said second and third locking devices to prevent the package being opened comprises a secondary tab member formed on said first tab member, said secondary tab member engaging a side wall.

5. The container of claim 1 further including a plurality of projections extending inwardly from at least one of said bottom member and said cover member.

6. The container of claim 1 further including means for receiving and retaining a blister package therein.

7. A child-resistant container comprising:

a bottom member adapted to receive and contain at least one item to be packaged, said bottom member having a base and at least one wall extending upwardly therefrom;

a cover member;

first, second and third cooperative locking devices on both said cover member and said bottom member;

said first, second and third locking devices being operative such that when said cover member is in a closed position with respect to the bottom member, said locking devices function to maintain the cover member and bottom member in a locked relationship;

said first locking device permitting limited movement between the cover member and bottom member while maintaining a locking relationship such that the second and third locking devices may be moved to an unlocked position while said first locking device is locked;

said second and third locking devices each including secondary locking means to prevent opening of the container when only one of said second and third locking devices is opened;

a plurality of projections extending inwardly from an inner surface of said bottom member;

a blister package having a plurality of blister pockets covered by a rupturable foil, said blister package being placed such that at least of said blister pockets rests on at least one of said projections such that when pressure is applied, a product in said blister pocket will be forced through said rupturable foil.

* * * * *